US011325023B1

(12) United States Patent
Keefe

(10) Patent No.: US 11,325,023 B1
(45) Date of Patent: May 10, 2022

(54) BOARD GAME APPARATUS

(71) Applicant: Stephen L. Keefe, North Chesterfield, VA (US)

(72) Inventor: Stephen L. Keefe, North Chesterfield, VA (US)

( * ) Notice: Subject to any disclaimer, the term of this patent is extended or adjusted under 35 U.S.C. 154(b) by 0 days.

(21) Appl. No.: 17/571,476

(22) Filed: Jan. 8, 2022

(51) Int. Cl.
*A63F 3/00* (2006.01)

(52) U.S. Cl.
CPC ..... *A63F 3/00261* (2013.01); *A63F 3/00214* (2013.01); *A63F 2003/00217* (2013.01); *A63F 2003/00268* (2013.01)

(58) Field of Classification Search
CPC ..... A63F 3/00261; A63F 3/00214; A63F 2003/00217; A63F 2003/00268; A63F 2003/00264; A63F 3/00173; A63F 2003/00271; A63F 2003/00274; A63F 2003/00277; A63F 2003/0028; A63F 2003/00283
See application file for complete search history.

(56) References Cited

U.S. PATENT DOCUMENTS 3,481,603 A * 12/1969 Sugden ..... A63F 3/00094 D21/336
3,884,474 A * 5/1975 Harper ..... A63F 3/00094 273/241
4,082,283 A 4/1978 La Ferla
4,348,027 A 9/1982 Escamilla-Kelly
4,778,186 A 10/1988 Dudley
6,276,685 B1 8/2001 Sterling
6,276,687 B1 8/2001 Lenhart
6,581,933 B1 * 6/2003 Zivan ..... A63F 3/00214 273/287
7,699,317 B2 4/2010 Eggers
8,517,384 B2 8/2013 Carbonaro
2011/0127720 A1 6/2011 Fourcell
2012/0112408 A1 5/2012 Poon

* cited by examiner

*Primary Examiner* — Michael D Dennis
(74) *Attorney, Agent, or Firm* — Stephen L. Keefe LLC

(57) ABSTRACT

A board game apparatus is disclosed. The board game apparatus has a support assembly, a first member rotatably supported by the support assembly, a second member rotatably supported by the support assembly and covering part of the first member, a board member rotatably supported by the support assembly and including a plurality of apertures, the board member covering the first member and the second member, and a raised member rotatably supported by the support assembly above the board member and forming a gap between the raised member and the board member. A first portion of the first member and a second portion of the second member are visible from above the board member through the plurality of apertures.

20 Claims, 8 Drawing Sheets

BOARD GAME APPARATUS

TECHNICAL FIELD

The present disclosure generally relates to a game apparatus, and more particularly to a board game apparatus.

BACKGROUND

Many multilevel board games exist to provide recreational game play for multiple players. Such conventional games typically involve multiple game boards that are disposed at differing vertical heights relative to each other. These types of games allow for expanded movement capabilities of game pieces and also for promotion and demotion of game pieces during play.

One such board game is disclosed by U.S. Pat. No. 7,699,317 to Eggers (the '317 patent). The '317 patent discloses a multi-dimensional strategy board game including a plurality of game boards disposed at different heights. The '317 patent allows for multiple players to compete against each other by moving opposing pieces against each other to capture game pieces of an opponent in an attempt to achieve an overall goal and prevail in the strategy game.

One shortcoming of the '317 patent is that this board game does not allow for players to work together to defeat a common threat or opponent. Further, the '317 patent does not allow for compelling solitaire play against a threat or opponent provided by an apparatus integrated into the game. Additionally, the '317 patent lacks game play in which one or more players may compete in three-dimensions against a threat or opponent provided by a moving apparatus of the board game itself.

The exemplary disclosed system, apparatus, and method of the present disclosure are directed to overcoming one or more of the shortcomings set forth above and/or other deficiencies in existing technology.

SUMMARY OF THE DISCLOSURE

In one exemplary aspect, the present disclosure is directed to a board game apparatus. The board game apparatus includes a support assembly, a first member rotatably supported by the support assembly, a second member rotatably supported by the support assembly and covering part of the first member, a board member rotatably supported by the support assembly and including a plurality of apertures, the board member covering the first member and the second member, and a raised member rotatably supported by the support assembly above the board member and forming a gap between the raised member and the board member. A first portion of the first member and a second portion of the second member are visible from above the board member through the plurality of apertures.

In another aspect, the present disclosure is directed to a method. The method includes rotatably supporting a first member using a support assembly, rotatably supporting a second member using the support assembly, the second member covering part of the first member, rotatably supporting a third member using the support assembly, the third member covering part of at least one of the first and second members, rotatably supporting a board member using the support assembly, the board member covering the first, second, and third members and including a plurality of apertures. The method also includes rotating a first location of the first member to one of a first plurality of locations of the support assembly based on a first random event, rotating a second location of the second member to one of the first plurality of locations of the support assembly based on a second random event, rotating a third location of the third member to one of the first plurality of locations of the support assembly based on a third random event, rotating a fourth location of the board member to one of a second plurality of locations of the support assembly based on a fourth random event, and viewing a first portion of the first member, a second portion of the second member, and a third portion of the third member from above the board member through the plurality of apertures.

DETAILED DESCRIPTION AND INDUSTRIAL APPLICABILITY

Figure 1:
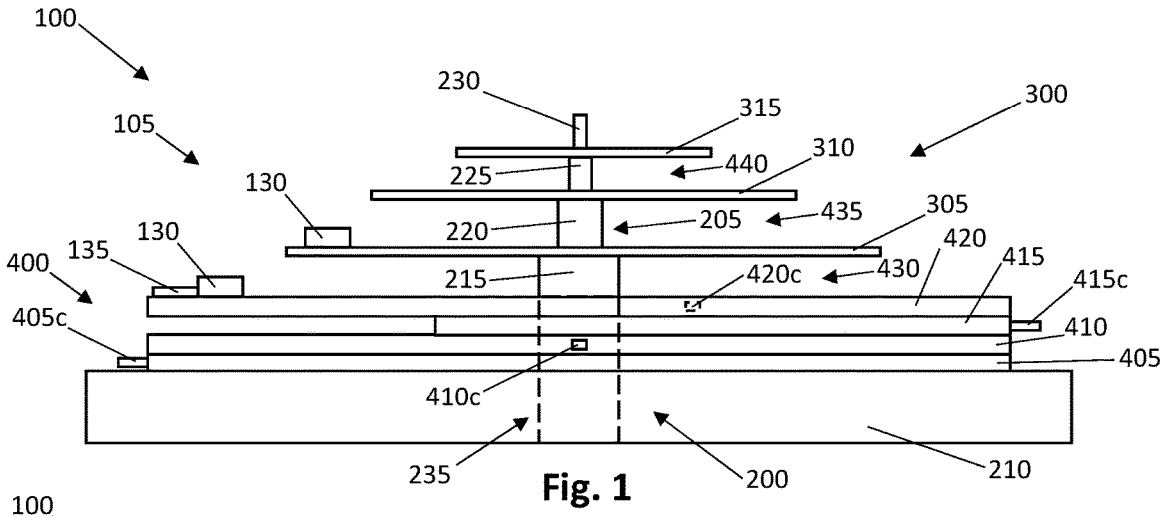
FIG. 1 is a cross-sectional view of at least some exemplary embodiments of the present invention.
Figure 2:
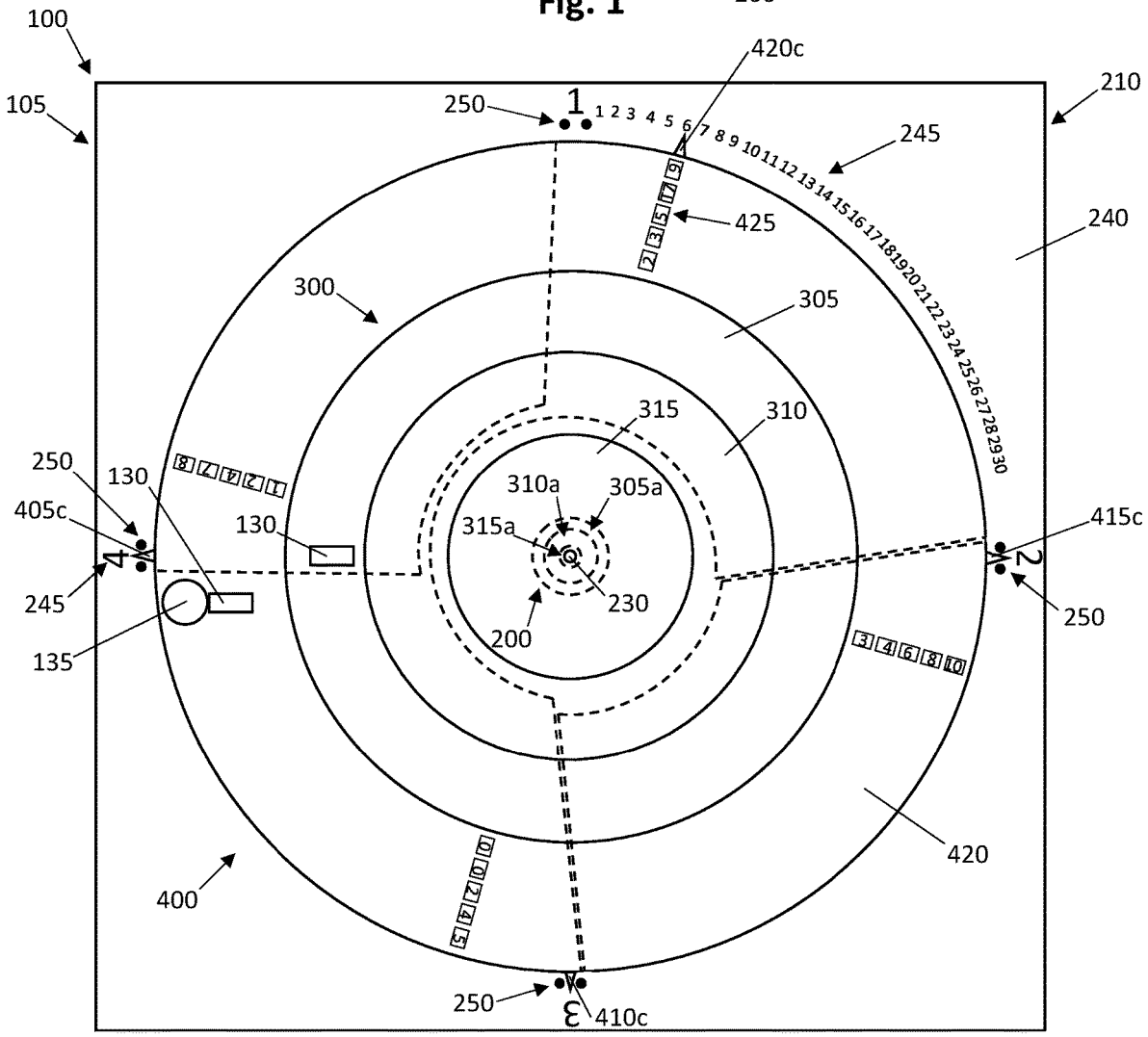
FIG. 2 is a plan view of at least some exemplary embodiments of the present invention.

FIGS. 1 and 2 illustrate an exemplary embodiment of the exemplary disclosed system, apparatus, and method. Board game system 100 may include an apparatus 105 (e.g., board game apparatus) and a playing piece set 110 (e.g., illustrated in FIGS. 11-14). Components of playing piece set 110 may be placed on apparatus 105 and/or used by one or more players in playing board game system 100.

Apparatus 105 may include a support assembly 200, a multilevel assembly 300, and a variable threat assembly 400. Support assembly 200 may support multilevel assembly 300 and variable threat assembly 400. For example, support assembly 200 may movably support (e.g., rotatably support) multilevel assembly 300 and variable threat assembly 400.

Support assembly 200 may include a multilevel support assembly 205 and a base member 210. Multilevel support assembly 205 may be supported by base member 210.

Figure 10:
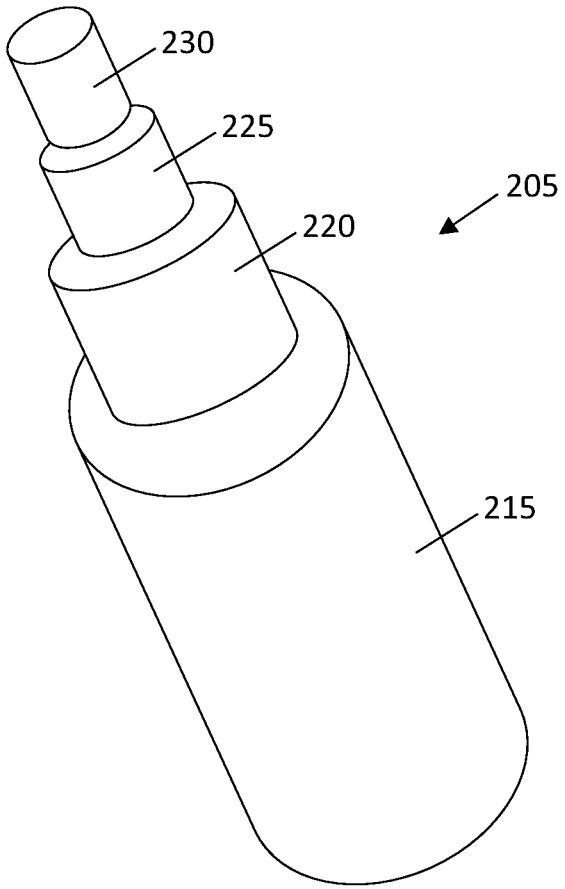
FIG. 10 is a perspective view of at least some exemplary embodiments of the present invention.
Figure 11:
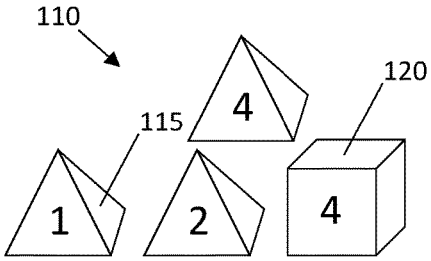
FIG. 11 is a perspective view of at least some exemplary embodiments of the present invention.

FIG. 10 illustrates an exemplary embodiment of multilevel support assembly 205. Multilevel support assembly 205 may include a first member 215, a second member 220, a third member 225, and a fourth member 230. Members 215, 220, 225, and 230 may be separate members that are removably attached or received by each other and/or are fixedly attached to each other. Members 215, 220, 225, and 230 may be integral portions of a single member forming multilevel support assembly 205. For example, member 230 may have a protrusion that may be removably received in an aperture of member 225, member 225 may have a protrusion that may be removably received in an aperture of member 220, and/or member 220 may have a protrusion that may be removably received in an aperture of member 215 (e.g., and/or the exemplary disclosed protrusions may be threaded and may be threadably received in the respective apertures that may be threaded). Members 215, 220, 225, and 230 may be magnetically stacked to each other to form the exemplary configuration illustrated in FIG. 10. Multilevel support assembly 205 may include any suitable shape or configuration for supporting members of multilevel assembly 300 at different heights above variable threat assembly 400. For example, members 215, 220, 225, and 230 may form a tiered structure for example as illustrated in FIG. 10. In at least some exemplary embodiments, members 215, 220, 225, and 230 may have progressively decreasing diameters that may be configured to receive members of variable threat assembly 400 and multilevel assembly 300 having varying apertures for example as described herein. Members 215, 220, 225, and 230 may also include any suitable fasteners (e.g., adhesive fasteners, magnetic fasteners, hook and loop fasteners, button fastener, and/or any suitable mechanical fastener) for attaching to and supporting members of variable threat assembly 400 and multilevel assembly 300. Members of variable threat assembly 400 and members of multilevel assembly 300 may be movably supported by multilevel support assembly 205 for example as described herein.

Multilevel support assembly 205 (e.g., including members 215, 220, 225, and 230) may be formed from any suitable material for supporting variable threat assembly 400 and multilevel assembly 300. Multilevel support assembly 205 may be formed from any suitable structural material. For example, multilevel support assembly 205 may be formed from plastic, wood, metal, composite material, cardboard, and/or any other suitable structural material. In at least some exemplary embodiments, multilevel support assembly 205 may be formed from polyethylene, polypropylene, vinyl, and/or polyvinyl material (e.g., polyvinyl chloride). Members 215, 220, 225, and 230 may have any suitable length such as, for example, between about ½" and about 2". For example, multilevel support assembly 205 may have an overall height or length of between about 2" and about 6" or any other suitable height or length.

Returning to FIGS. 1 and 2, base member 210 may be any suitable member for supporting multilevel support assembly 205 and variable threat assembly 400. For example, base member 210 may include an aperture 235 that may be configured (e.g., sized and shaped) to receive multilevel support assembly 205 (e.g., first member 215).

Base member 210 may be formed from any suitable material for supporting multilevel support assembly 205 and variable threat assembly 400 such as, for example, material similar to multilevel support assembly 205. In at least some exemplary embodiments, base member 210 may be a cardboard box such as a corrugated cardboard box, a plastic member such as a hollow plastic member stiffened by ribs or other suitable stiffener members, and/or any other suitable member for receiving and supporting multilevel support assembly 205 in a substantially vertical position. Base member 210 may have any suitable thickness for supporting multilevel support assembly 205 and variable threat assembly 400 such as, for example, between about ½" and about 1" (e.g., about ¾" or any other suitable thickness). Base member 210 may alternatively be a relatively thin member (e.g., a sheet member) that may be relatively rigid (e.g., stiff) and that may be attached to a lower portion of first member 215. Base member 210 may also be integrally formed with multilevel support assembly 205 (e.g., a sheet member or a box member integrally formed with multilevel support assembly 205). Variable threat assembly 400 may be directly and movably (e.g., rotatably) supported on a surface 240 (e.g., an upper surface) of base member 210. A plurality of markings 245 (e.g., "1" through "4" numerals located at edge portions of base member 210 and/or "1" through "30" numerals and/or any other desired numerals or markings for use in game play) may be provided at surface 240. For example, markings 245 may be printed, etched, engraved, disposed on a layer (e.g., a sticker) adhered to surface 240, and/or provided via any other suitable technique at surface 240 (e.g., and/or any other suitable surface or location of apparatus 105). Markings 245 may be utilized by users (e.g., players) in using board game system 100. Base member 210 may also include one or more (e.g., a plurality of) fastener assemblies 250 that may selectively fasten portions of variable threat assembly 400 for example as described further below.

Multilevel assembly 300 may include a first member 305, a second member 310, and a third member 315. Members 305, 310, and 315 may be supported at different heights from each other by multilevel support assembly 205.

Members 305, 310, and 315 may be annular (e.g., circular) members that may be relatively thin (e.g., a sheet members). First member 305 may be sized larger (e.g., have a larger diameter) and be supported at a lower height than second member 310 by multilevel support assembly 205. Second member 310 may be sized larger (e.g., have a larger diameter) and be supported at a lower height than third member 315 by multilevel support assembly 205. First member 305 may include an aperture **305*a* that may be sized (e.g., shaped or dimensioned) to be received by multilevel support assembly 205 (e.g., by second member 220). First member 305 may be movably (e.g., rotatably) supported by multilevel support assembly 205 based on first member 305 rotating about second member 220 when aperture 305*a* receives second member 220 and a portion of a bottom surface of first member 305 rests on an upper surface of first member 215. Second member 310 may include an aperture 310*a* that may be sized (e.g., shaped or dimensioned) to be received by multilevel support assembly 205 (e.g., by third member 225). Second member 310 may be movably (e.g., rotatably) supported by multilevel support assembly 205 based on second member 310 rotating about third member 225 when aperture 310*a* receives third member 225 and a portion of a bottom surface of second member 310 rests on an upper surface of second member 220. Third member 315 may include an aperture 315*a* that may be sized (e.g., shaped or dimensioned) to be received by multilevel support assembly 205 (e.g., by fourth member 230). Third member 315 may be movably (e.g., rotatably) supported by multilevel support assembly 205 based on third member 315 rotating about fourth member 230 when aperture 315*a* receives fourth member 230 and a portion of a bottom surface of third member 315 rests on an upper surface of third member 225**.

Figure 3:
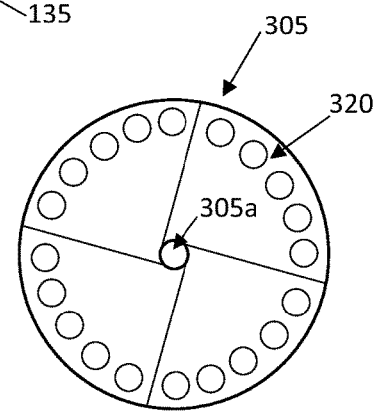
FIG. 3 is a plan view of at least some exemplary embodiments of the present invention.

Members 305, 310, and 315 may be relatively thin sheet members that may be relatively rigid or stiff to maintain a substantially horizontal shape or alignment across their respective width or diameters when supported by multilevel support assembly 205. In at least some exemplary embodiments, members 305, 310, and 315 may include stiffeners (e.g., stiff portions such as washers) at respective apertures 305*a*, 310*a*, and 315*a*. Members 305, 310, and 315 may be formed from transparent and/or translucent material. For example, members 305, 310, and 315 may be formed from transparent and/or translucent plastic or glass material. In at least some exemplary embodiments, members 305, 310, and 315 may be formed from rigid and transparent plastic sheet members. A user may thereby look through members 305, 310, and 315 to see markings on members of variable threat assembly 400 (e.g., exemplary disclosed markings for example as described herein). First member 305 may include markings 320 for example as illustrated in FIG. 3. Markings 320 may be provided by any suitable technique such as, for example, similarly to as described above regarding markings 245. Second member 310 and third member 315 may include similar markings as markings 320. Markings 320 may be any suitable markings for guiding game play for players of board game system 100. The exemplary disclosed markings may correspond to and be aligned with exemplary disclosed markings of variable threat assembly 400. For example during game play of board game system 100, members 305, 310, and 315 may be moved (e.g., rotated) to maintain alignment with an exemplary disclosed member of variable threat assembly 400 based on the exemplary disclosed markings (e.g., maintain alignment of some or substantially all of the markings). Members 305, 310, and 315 may be moved independently of each other relative to support assembly 200. Members 305, 310, and 315 may be raised members. As illustrated in FIG. 1, a first gap 430 may be formed between first member 305 and a board member 420 of variable threat assembly 400. A second gap 435 may be formed between first member 305 and second member 310. A third gap 440 may be formed between second member 310 and third member 315.

Returning to FIGS. 1 and 2, variable threat assembly 400 may include a full member 405, a first partial member 410, a second partial member 415, and board member 420. Members 405, 410, 415, and 420 may be supported directly (e.g., and movably supported) by base member 210 and movably supported by multilevel support assembly 205.

Members 405, 410, 415, and 420 may be annular members (e.g., circular, partially circular, wedge-shaped, or arc members) that may be relatively thin (e.g., a sheet members). Members 405, 410, 415, and 420 may be relatively thin sheet members that may be relatively rigid or stiff to maintain a substantially horizontal shape or alignment across their respective width or diameters when movably (e.g., rotatably) supported by base member 210 and multilevel support assembly 205. Members 405, 410, 415, and 420 may be formed from material similar to support assembly 200 or multilevel assembly 300. In at least some exemplary embodiments, members 405, 410, 415, and 420 may be formed from cardboard, paper, plastic, and/or any other suitable material for being movably supported by base member 210 and multilevel support assembly 205. Members 405, 410, 415, and 420 may have any suitable thickness such as, for example, between about 1/16" and about 1/4" or 1/2" or any other suitable thickness.

Figure 4:
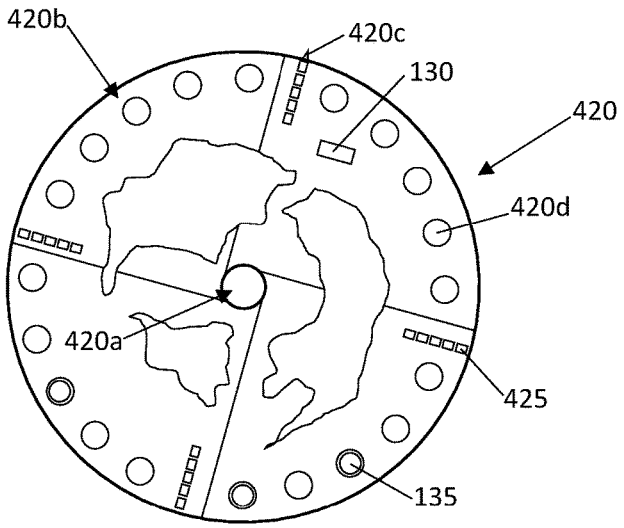
FIG. 4 is a plan view of at least some exemplary embodiments of the present invention.
Figure 5:
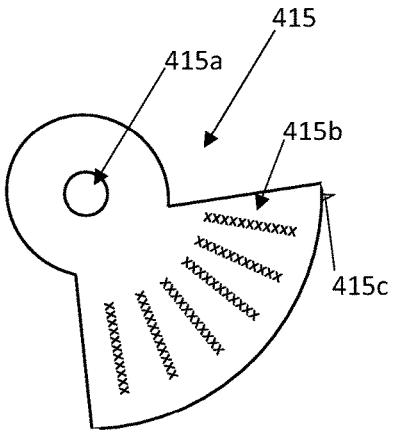
FIG. 5 is a plan view of at least some exemplary embodiments of the present invention.
Figure 6:
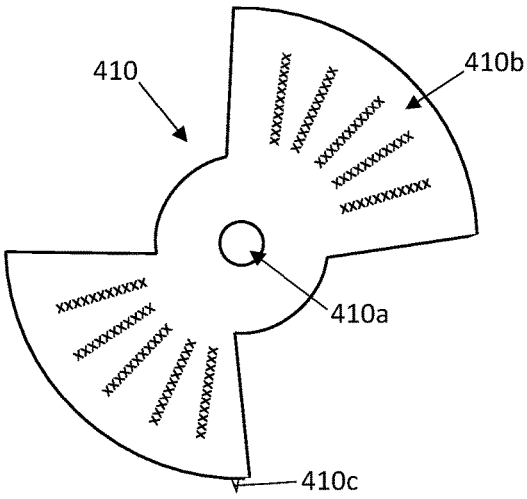
FIG. 6 is a plan view of at least some exemplary embodiments of the present invention.
Figure 7:
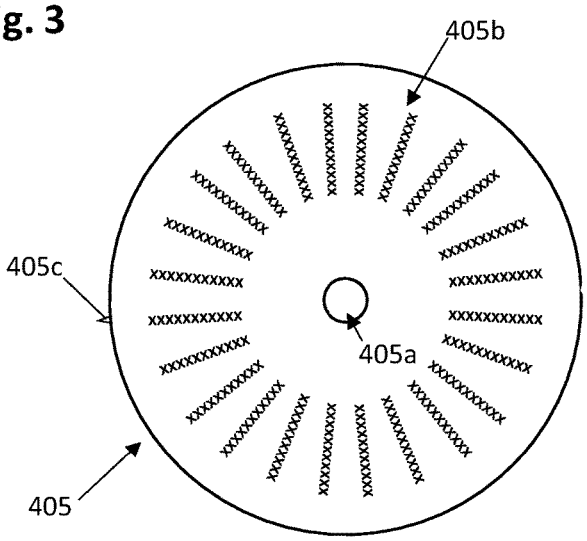
FIG. 7 is a plan view of at least some exemplary embodiments of the present invention.

Full member 405 may be disposed on (e.g., directly contact) surface 240 of base member 210. Full member 405 may be a bottom member of variable threat assembly 400. First partial member 410 may be disposed on (e.g., directly contact) full member 405. Second partial member 415 may be disposed on (e.g., directly contact) first partial member 410. Board member 420 may be disposed on (e.g., directly contact) second partial member 415. As illustrated in FIG. 7, full member 405 may include an aperture 405*a* that may be sized (e.g., shaped or dimensioned) to be received by multilevel support assembly 205 (e.g., by first member 215). Full member 405 may be movably (e.g., rotatably) supported by multilevel support assembly 205 based on full member 405 rotating about first member 215 when aperture 405*a* receives first member 215 and a bottom surface of full member 405 rests on surface 240 of base member 210. As illustrated in FIG. 6, first partial member 410 may include an aperture 410*a* that may be sized (e.g., shaped or dimensioned) to be received by multilevel support assembly 205 (e.g., by first member 215). First partial member 410 may be movably (e.g., rotatably) supported by multilevel support assembly 205 based on first partial member 410 rotating about first member 215 when aperture 410*a* receives first member 215 and a bottom surface of first partial member 410 rests on an upper surface of full member 405. As illustrated in FIG. 5, second partial member 415 may include an aperture 415*a* that may be sized (e.g., shaped or dimensioned) to be received by multilevel support assembly 205 (e.g., by first member 215). Second partial member 415 may be movably (e.g., rotatably) supported by multilevel support assembly 205 based on second partial member 415 rotating about first member 215 when aperture 415*a* receives first member 215 and a bottom surface of second partial member 415 rests on an upper surface of first partial member 410. As illustrated in FIG. 4, board member 420 may include an aperture 420*a* that may be sized (e.g., shaped or dimensioned) to be received by multilevel support assembly 205 (e.g., by first member 215). Board member 420 may be movably (e.g., rotatably) supported by multilevel support assembly 205 based on board member 420 rotating about first member 215 when aperture 420*a* receives first member 215 and a portion of a bottom surface of board member 420 rests on an upper surface of second partial member 415. Members 405, 410, 415, and 420 may be moved independently of each other relative to support assembly 200.

Figure 8:
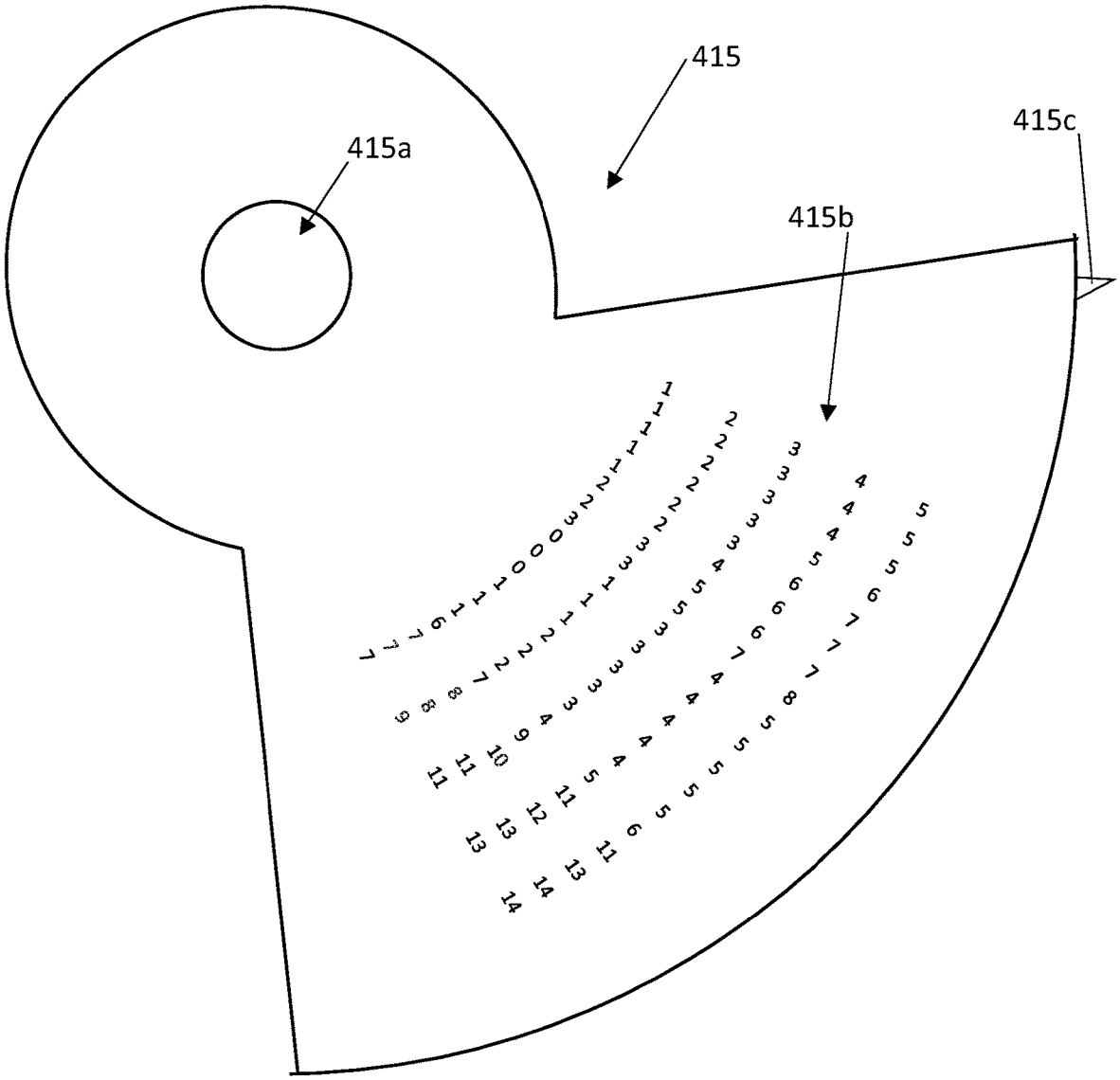
FIG. 8 is a plan view of at least some exemplary embodiments of the present invention.
Figure 9:
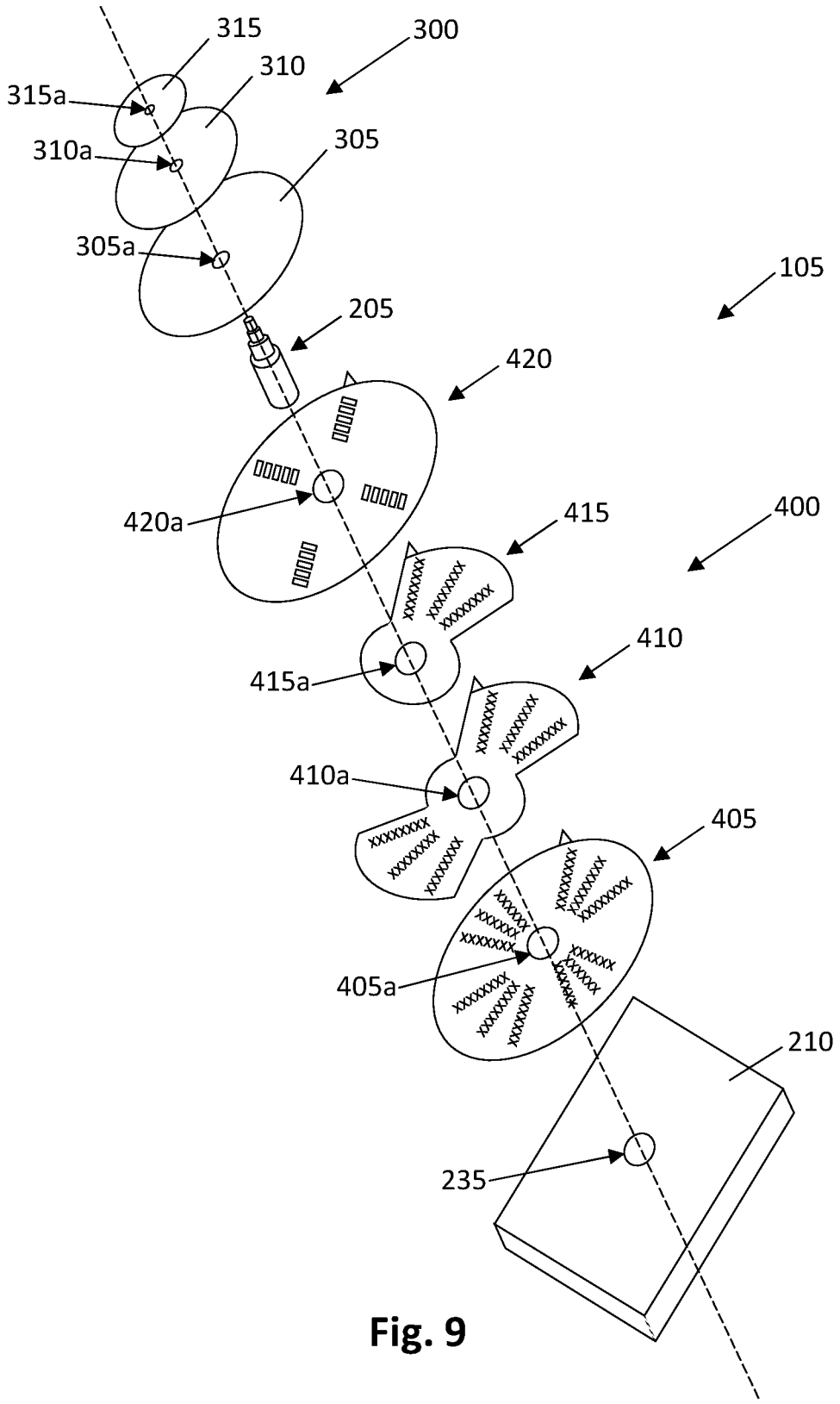
FIG. 9 is an exploded perspective view of at least some exemplary embodiments of the present invention.

As illustrated in FIG. 7 and in at least some exemplary embodiments, full member 405 may be a full annular or circular shape. Full member 405 may include markings 405*b*. Markings 405*b* may be provided by any suitable technique such as, for example, similarly to as described above regarding markings 245. Markings 405*b* may include for example an array of characters such as numbers as illustrated in FIG. 8. Markings 405*b* may also include letters, symbols, and/or any other suitable markings for game play of board game system 100. Returning to FIG. 7, markings 405*b* may be provided along a partial or substantially full perimeter (e.g., in a radial direction between aperture 405*a* and a periphery or edge of full member 405) about aperture 405*a*. Markings 405*b* may be provided on one or both sides (e.g., both opposing surfaces) of full member 405. Markings 405*b* may be aligned with apertures of board member 420 to be selectively visible to users (e.g., players of board game system 100) for example as described herein. Full member 405 may also include a protrusion 405*c* (e.g., a protruding pointer portion) that may be selectively aligned with markings 245 (e.g., the "1" through "4" numerals located at quarters of base member 210). Protrusion 405*c* may be formed from similar material as described above for full member 405.

As illustrated in FIG. 6 and in at least some exemplary embodiments, first partial member 410 may be an annular or semi-circular shape. For example, first partial member 410 may include a plurality (e.g., two or three) wedge-shaped portions that may comprise a half-circle (e.g., or a two-thirds or three-quarters circle). First partial member 410 may include markings 410*b*. Markings 410*b* may be provided by any suitable technique such as, for example, similarly to as described above regarding markings 245. Markings 410*b* may include for example an array of characters such as numbers as illustrated in FIG. 8. Markings 410*b* may also include letters, symbols, and/or any other suitable markings for game play of board game system 100. Returning to FIG. 6, markings 410*b* may be provided along a partial or substantially full perimeter (e.g., in a radial direction between aperture 410*a* and a periphery or edge of first partial member 410) about aperture 410*a*. Markings 410*b* may be provided on one or both sides (e.g., both opposing surfaces) of first partial member 410. Markings 410*b* may be aligned with apertures of board member 420 to be selectively visible to users (e.g., players of board game system 100) for example as described herein. First partial member 410 may also include a protrusion 410*c* (e.g., a protruding pointer portion) that may be selectively aligned with markings 245 (e.g., the "1" through "4" numerals located at quarters of base member 210). Protrusion 410*c* may be formed from similar material as described above for first partial member 410.

As illustrated in FIGS. 5 and 8 and in at least some exemplary embodiments, second partial member 415 may be an annular or semi-circular shape. For example, second partial member 415 may be a wedge shape. For example, second partial member 415 may include a wedge-shaped portion that may comprise a quarter-circle (e.g., or a sixth-circle or a third-circle). Second partial member 415 may include markings 415*b*. Markings 415*b* may be provided by any suitable technique such as, for example, similarly to as described above regarding markings 245. Markings 415*b* may include for example an array of characters such as numbers as illustrated in FIG. 8. Markings 415*b* may also include letters, symbols, and/or any other suitable markings for game play of board game system 100. Markings 415*b* may be provided along a partial or substantially full perimeter (e.g., in a radial direction between aperture 415*a* and a periphery or edge of second partial member 415) about aperture 415*a*. Markings 415*b* may be provided on one or both sides (e.g., both opposing surfaces) of second partial member 415. Markings 415*b* may be aligned with apertures of board member 420 to be selectively visible to users (e.g., players of board game system 100) for example as described herein. Second partial member 415 may also include a protrusion 415*c* (e.g., a protruding pointer portion) that may be selectively aligned with markings 245 (e.g., the "1" through "4" numerals located at quarters of base member 210). Protrusion 415*c* may be formed from similar material as described above for second partial member 415.

As illustrated in FIGS. 2 and 4 and in at least some exemplary embodiments, board member 420 may be a full annular or circular shape. For example as illustrated in FIG. 4, board member 420 may include markings 420*b*. Markings 420*b* may be provided by any suitable technique such as, for example, similarly to as described above regarding markings 245. Markings 420*b* may include for example an array of shapes such as circles disposed around a periphery of board member 420, a map, a grid or pattern for moving playing pieces, and/or any other suitable markings for use in playing a game of board game system 100. Markings 420*b* may also include letters, symbols, and/or any other suitable markings for game play of board game system 100. Markings 420*b* may be provided on one or both sides (e.g., both opposing surfaces) of board member 420. Board member 420 may also include a protrusion 420*c* (e.g., a protruding pointer portion) that may be selectively aligned with markings 245 (e.g., "1" through "4" numerals located at quarters of base member 210). Protrusion 420*c* may be formed from similar material as described above for board member 420.

As illustrated in FIGS. 2 and 4 and in at least some exemplary embodiments, board member 420 may include a plurality of apertures 425. Apertures 425 may be cut-outs of any desired shape (e.g., square, rectangle, annular or circular, oval, diamond, and/or any other desired shape) through board member 420. Apertures 425 may extend through a thickness of board member 420 so that a user (e.g., a player) may view markings 405*b*, 410*b*, and/or 415*b* of respective members 405, 410, and 415 through apertures 425 (e.g., from above board member 420). Markings 405*b*, 410*b*, and 415*b* may be aligned with apertures 425 so that they may be selectively viewed through apertures 425 based on a relative position of board member 420 with members 405, 410, and 415 (e.g., for example as illustrated in FIG. 2). A plurality of apertures 425 may be disposed in a row or array or any other desired pattern in board member 420. For example, rows or other desired patterns of apertures 425 may be disposed at any desired location of board member 420 (e.g., at each quarter, third, sixth, or any desired locations of board member 420). For example as illustrated in FIGS. 2 and 4, rows of apertures 425 may be disposed at each quarter (e.g., or each third or each sixth or any other desired interval) of board member 420.

Protrusions 405*c*, 410*c*, and 415*c* (e.g., and 420*c*) may be selectively fastened by one or more fastener assemblies 250 of base member 210. For example, fastener assembly 250 may include a plurality of flexible pegs between which protrusions 405*c*, 410*c*, and 415*c* (e.g., and 420*c*) may be selectively held or maintained. Fastener assemblies 250 and protrusions 405*c*, 410*c*, and 415*c* (e.g., and 420*c*) may also comprise components of any other suitable fastening device such as, for example, mechanical fasteners, magnetic fasteners, hook and loop fasteners, button fastener, adhesive fasteners, and/or any suitable fastener for selectively holding or maintaining members 405, 410, 415, and/or 420 in place. In at least some exemplary embodiments, fastener assembly 250 may include a recess that may removably receive a peg that may be received through an aperture of the exemplary disclosed members and in the recess of fastener assembly 250. Members 405, 410, 415, and/or 420 may thereby be selectively held or maintained in place (e.g., selectively prevented from moving by removably attaching) by one or more fastener assemblies 250.

Figure 15:
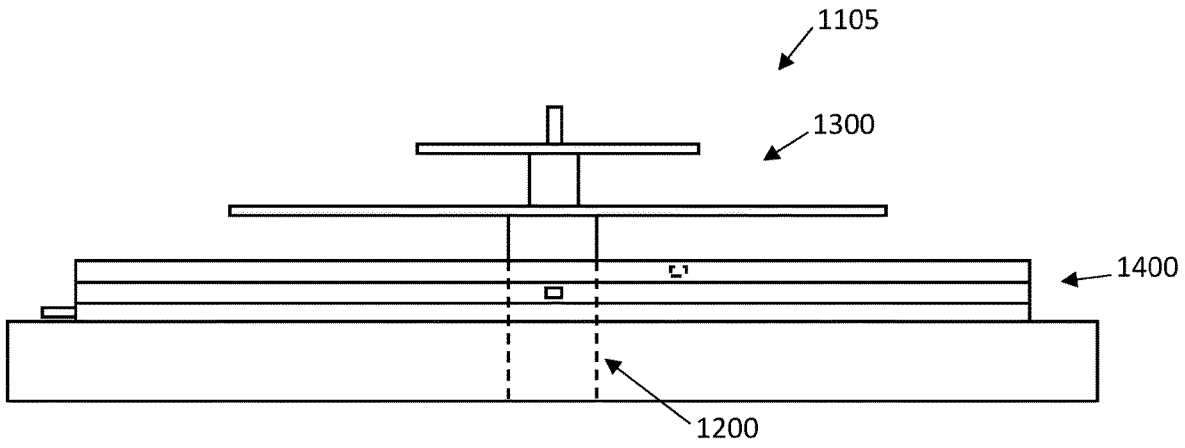
FIG. 15 is a cross-sectional view of at least some exemplary embodiments of the present invention.
Figure 16:
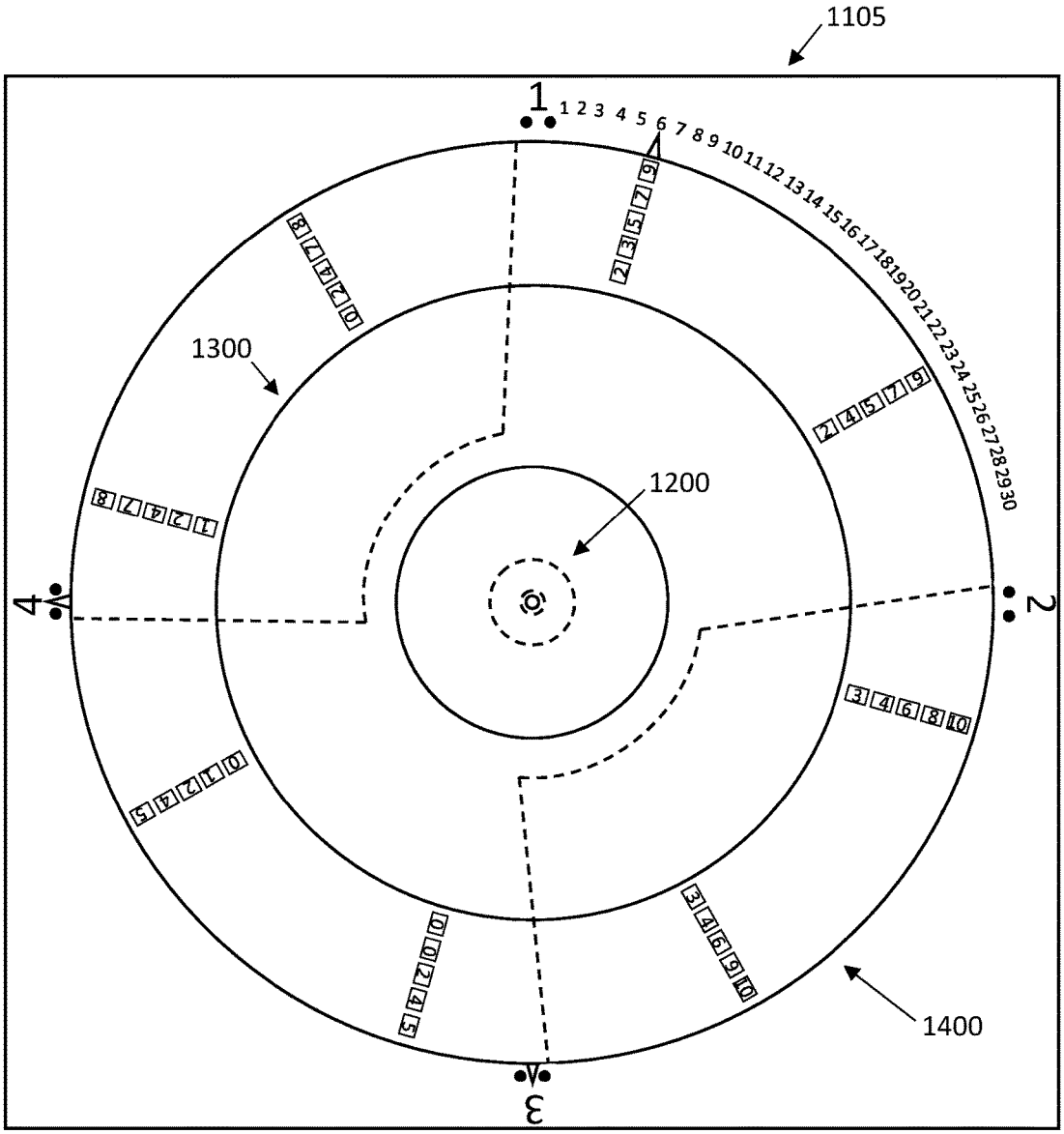
FIG. 16 is a plan view of at least some exemplary embodiments of the present invention.

Each of multilevel assembly 300 and variable threat assembly 400 may include any desired number of members. For example, multilevel assembly 300 may include any desired number of members (e.g., one, two, three, four, five, or more members) that may be similar to members 305, 310, and/or 315. Also for example, variable threat assembly 400 may include any desired number of members (e.g., one, two, three, four, five, or more members) that may be similar to members 405, 410, 415, and/or 420. For example as illustrated in FIGS. 15 and 16, an apparatus 1105 may include a support assembly 1200 movably supporting a multilevel assembly 1300 having two members (e.g., or any other desired number of members) and a variable threat assembly 1400 including three members (e.g., or any other desired number of members). In at least some exemplary embodiments, components of the exemplary disclosed board game system may be dimensioned or configured to be able to fit into a game box of any suitable dimensions (e.g., between about 6"×6" and about 12"×12" or 12"×10" or any other desired dimensions).

FIGS. 11 through 14 illustrate exemplary playing pieces of playing piece set 110. The exemplary disclosed playing piece set 110 may be formed from any suitable materials for forming board game playing pieces such as materials disclosed regarding apparatus 105 above (e.g., the exemplary disclosed plastic, paper, cardboard, metal, and/or other suitable materials disclosed above). Playing piece set 110 may include a die 115 and/or die 120 (e.g., dice 115 and/or 120) such as, for example, 4-sided die, 6-sided die, eight-sided die, and/or any other suitable number-sided die. Dice 115 and/or 120 may be used to provide random events (e.g., die rolls) during game play of board game system 100. Playing piece set 110 may include a plurality of playing cards 125 (e.g., a deck of playing cards). Playing piece set 110 may include a plurality of markers 130 (e.g., unit markers) that may represent any desired type of game unit marker such as, for example, a ship or naval vessel, aircraft, spacecraft, fantasy characters or monsters and/or any other desired type of vehicle or object for use in playing a game of game board system 100 (e.g., for example as described herein). Playing piece set 110 may include a plurality of tokens 135 that may represent any desired type of object or item such as, for example, a city, a region, a valuable item to be protected, a goal, a port or landing strip, and/or any other desired type of vehicle or object for use in playing a game of game board system 100 (e.g., for example as described herein).

The exemplary disclosed system, apparatus, and method may be used in any suitable application for providing a board game. For example, the exemplary disclosed system, apparatus, and method may be used in any suitable board game involving one player or a plurality of players. The exemplary disclosed system, apparatus, and method may for example be used in military board games, fantasy board games, educational board games, cooperative board games, competitive board games, and/or any other suitable board game type involving a variable threat or opponent. The exemplary disclosed system, apparatus, and method may be used in any suitable multilevel board game.

Figure 17:
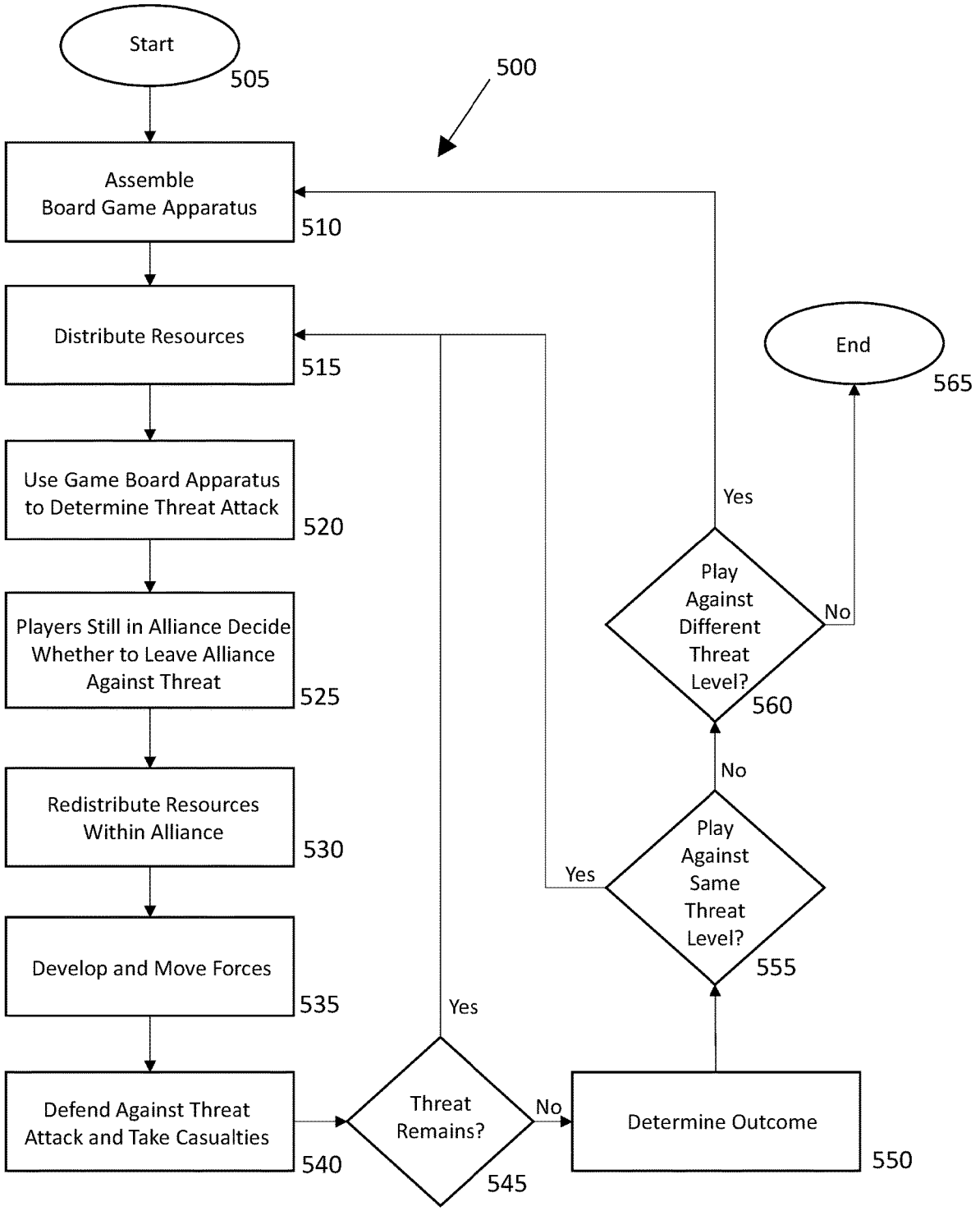
FIG. 17 illustrates an exemplary process of at least some exemplary embodiments of the present disclosure.

FIG. 17 illustrates an exemplary operation for using exemplary disclosed board game system 100 including apparatus 105. Process 500 begins at step 505.

At step 510, users (e.g., players) may assemble apparatus 105. For example, first member 215 of multilevel support assembly 205 may be inserted into aperture 235 of base member 210. Full member 405 may be movably disposed on base member 210 based on first member 215 of multilevel support assembly 205 being received through aperture 405*a* of full member 405. First partial member 410 may be movably disposed on full member 405 based on first member 215 of multilevel support assembly 205 being received through aperture 410*a* of first partial member 410. Second partial member 415 may be movably disposed on first partial member 410 based on first member 215 of multilevel support assembly 205 being received through aperture 415*a* of second partial member 415. Board member 420 may be movably disposed on second partial member 415 based on first member 215 of multilevel support assembly 205 being received through aperture 420*a* of board member 420. A desired side or surface of each of members 405, 410, 415, and 420 having desired exemplary disclosed markings may be disposed facing upward based for example on a desired difficulty threat level to be used during game play of board game system 100.

First member 305 may then be movably disposed on multilevel support assembly 205 based on aperture 305*a* receiving second member 220 and a portion of a bottom surface of first member 305 resting on an upper surface of first member 215. Second member 310 may then be movably disposed on multilevel support assembly 205 based on aperture 310*a* receiving third member 225 and a portion of a bottom surface of second member 310 resting on an upper surface of second member 220. Third member 315 may then be movably disposed on multilevel support assembly 205 based on aperture 315*a* receiving fourth member 230 and a portion of a bottom surface of third member 315 resting on an upper surface of third member 225. Apparatus 105 may thereby be assembled for example in the exemplary embodiment illustrated in FIGS. 1 and 2.

Returning to FIG. 17, game play resources may be distributed at step 515. For example, users (e.g., players) may receive one or more markers 130 that may be disposed on a portion of board member 420 corresponding to a given player (e.g., a territory or region corresponding to a given player). For example, each of four players may control a quarter (e.g., or any other portions by any desired number of players) of board member 420 and each of members 305, 310, and 315 disposed above a respective quarter. In at least some exemplary embodiments, members 305, 310, and 315 may represent airspace above a given region. For example in at least some exemplary embodiments, board member 420 may represent a nation, the world, or an imaginary world or realm, or any other desired area (e.g., and members 305, 310, and 315 may represent different portions or altitudes of a sky or space over the region). Also in at least some exemplary embodiments, board member 420 and members 305, 310, and 315 may represent depths of ocean and/or airspace over an ocean such as, for example, when board game system 100 may be a maritime or naval game. Markers 130 may represent ships, aircraft, soldiers, submarines, fantasy characters (e.g., dragons), characters on broomsticks, aircraft carriers, armies, fleets, and/or any other desired vehicles, characters, objects, or groups. In at least some exemplary embodiments, markers 130 may be initially placed on board member 420, and may be moved upward over board member 420 to members 305, 310, 315 as game play of board game system 100 progresses.

Figure 14:
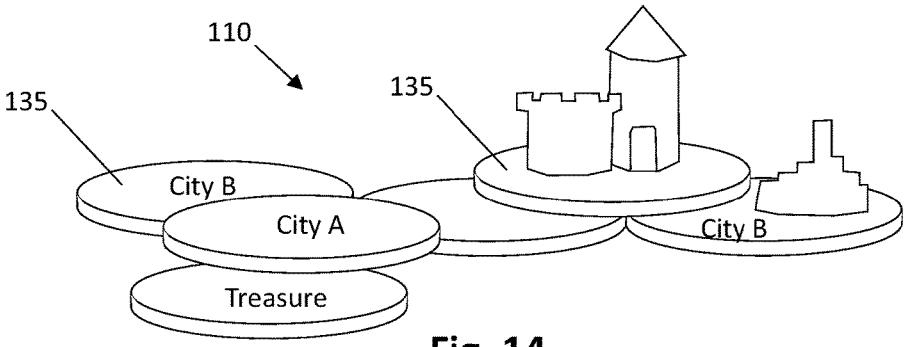
FIG. 14 is a perspective view of at least some exemplary embodiments of the present invention.

Tokens 135 may also be disposed on board member 420. For example, tokens 135 may be placed by respective players on designated portions of board member 420 such as locations 420*d* as illustrated in FIG. 4. Markers 130 may also be placed at locations 420*d* and similar locations of members 305, 310, and 315 for example as illustrated in FIG. 3 (e.g., that may be aligned with corresponding locations 420*d*). Tokens 135 may represent assets to be protected such as a city, a region, a city region, a castle, a port, a landing strip, a magical item, a naval convoy to be protected, a treasure, and/or any other desired asset. Tokens 135 may represent assets of varying value such as, for example, type "A" or type "B" assets as illustrated in FIG. 14. The value of a given token 135 may determine an amount of playing cards 125, play money, treasure, or other measures of game worth that may be received by a given player (e.g., each turn). In at least some exemplary embodiments, some tokens 135 may be "A" value cities for which players may receive two playing cards 125 each turn and other tokens 135 may be "B" value cities for which players may receive one playing card 125 each turn. Tokens 135 may represent any desired item, object, or group that may provide a given player with any desired asset or benefit during game play of board game system 100.

Figure 12:
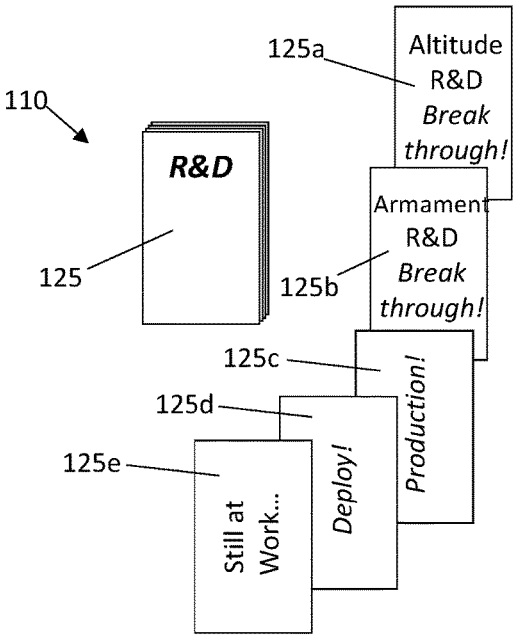
FIG. 12 is a plan view of at least some exemplary embodiments of the present invention.
Figure 13:
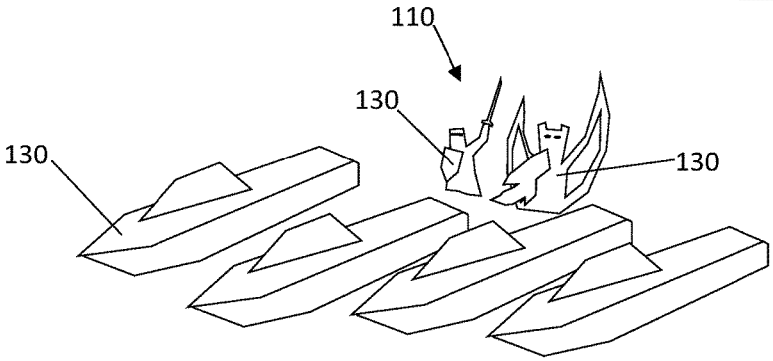
FIG. 13 is a perspective view of at least some exemplary embodiments of the present invention.

As illustrated in FIG. 12, playing cards 125 may illustrate any desired asset or benefit for any type of desired game play (e.g., research and development value or progress, money, treasure, armies, fleets, fantasy characters or monsters, magical abilities, and/or any other desired attribute for game play). For example, each given playing card 125 may provide players with opportunities to build markers 130, move markers 130 between regions of members 420, 305, 310, and 315 and between different members 420, 305, 310, and 315 (e.g., moving up from member 420 to members 305, 310, and/or 315). Playing cards 125 may also include no benefit to players and/or liabilities or disadvantages for players.

In one exemplary embodiment, markers 130 may be gunships that may defend city regions represented by tokens 135 (e.g., each player may receive two "A" city tokens 135 that each provide two playing cards 125 each turn and three "B" city tokens 135 that each provide one playing card 125 each turn). Each player may begin play with three gunship markers 130 that may each begin play on board member 420. As illustrated in FIG. 12, a deck of playing cards 125 may include playing cards 125*a* that may be research and development (R&D) breakthrough cards for altitude (e.g., allows a player to move markers 130 up one additional level in general for example from board member 420 to first member 305, which may make markers 130 more powerful during game play), playing cards 125*b* that may be research and development (R&D) breakthrough cards for armament (e.g., makes markers 130 more powerful during game play), playing cards 125*c* that may be production cards (e.g., allow players to receive additional markers 130), playing cards 125*d* that may be deployment cards (e.g., allow players to move markers 130 up one level to a maximum level based on altitude R&D playing cards 125*a* that a given player has received), and playing cards 125*e* that may be still-working cards (e.g., that may give no benefit to players). A deck of any desired number of playing cards 125 may be provided with any desired number or combination of playing cards 125 to yield any desired probability mix of benefits to players. For example, a deck of 84 cards including four playing cards 125*a*, five playing cards 125*b*, six playing cards 125*c*, thirty playing cards 125*d*, and thirty-nine playing cards 125*e* may be provided for use by players during game play of board game system 100. Any other desired type of playing cards 125 may be provided for any type of game theme or type of game provided by board game system 100 such as, for example, playing cards for depth R&D of submarines, missile development R&D, types of magical spells or weapons, armor level for example for knights, battleships, or armored vehicles, weapons ranges, broomstick speed, monster abilities such as breathing ice or fire, catapult range, antiaircraft or anti-ballistic missile fire, and/or any other desired advantage, benefit, or liability for any desired type of game. For example as described herein, playing cards 125 may be used to formulate defense and/or attack values that may be compared to defense and/or attack values determined by player use of variable threat assembly 400. In at least some exemplary embodiments, dice or any other suitable playing pieces may be used with or instead of playing cards 125 to determine resources to be distributed to players.

At step 520, one or more players of board game system 100 may use apparatus 105 to determine a threat attack or any other suitable game play operation. For example, a player may roll a first die 115 (e.g., a 4-sided die including numbers 1-4 or any other suitable set of letters, characters, or symbols that may match or correspond to markings 245 such as "1" through "4" numerals located at edge portions of base member 210). In at least some exemplary embodiments, first die 115 may be of a first color that may correspond to a color of full member 405 (e.g., of protrusion 405*c*). A player may rotate full member 405 about multilevel support assembly 205 so that protrusion 405*c* points to a reference numeral or character of markings 245 corresponding to a numeral or character rolled on first die 115. For example if a player rolls a "4" using first die 115, the player may rotate full member 405 so that protrusion 405*c* points to a "4" of markings 245 for example as illustrated in FIG. 2. The player may then utilize one or more fastener assemblies 250 for example as described above to selectively hold or maintain full member 405 in place relative to base member 210.

Further at step 520, a player may roll a second die 115 (e.g., a 4-sided die including numbers 1-4 or any other suitable set of letters, characters, or symbols that may match or correspond to markings 245 such as "1" through "4" numerals located at edge portions of base member 210). In at least some exemplary embodiments, second die 115 may be of a second color that may correspond to a color of first partial member 410 (e.g., of protrusion 410*c*). A player may rotate first partial member 410 about multilevel support assembly 205 so that protrusion 410*c* points to a reference numeral or character of markings 245 corresponding to a numeral or character rolled on second die 115. Because full member 405 may be selectively held or maintained in place on base member 210, full member 405 may not move or rotate as first partial member 410 is moved or rotated. For example if a player rolls a "3" using second die 115, the player may rotate first partial member 410 so that protrusion 410*c* points to a "3" of markings 245 for example as illustrated in FIG. 2. The player may then utilize one or more fastener assemblies 250 for example as described above to selectively hold or maintain first partial member 410 in place relative to base member 210 (e.g., and full member 405).

Further at step 520, a player may roll a third die 115 (e.g., a 4-sided die including numbers 1-4 or any other suitable set of letters, characters, or symbols that may match or correspond to markings 245 such as "1" through "4" numerals located at edge portions of base member 210). In at least some exemplary embodiments, third die 115 may be of a third color that may correspond to a color of second partial member 415 (e.g., of protrusion 415*c*). A player may rotate second partial member 415 about multilevel support assembly 205 so that protrusion 415*c* points to a reference numeral or character of markings 245 corresponding to a numeral or character rolled on third die 115. Because full member 405 and first partial member 410 may be selectively held or maintained in place on base member 210, full member 405 and first partial member 410 may not move or rotate as second partial member 415 is moved or rotated. For example if a player rolls a "2" using third die 115, the player may rotate second partial member 415 so that protrusion 415*c* points to a "2" of markings 245 for example as illustrated in FIG. 2. The player may then utilize one or more fastener assemblies 250 for example as described above to selectively hold or maintain second partial member 415 in place relative to base member 210 (e.g., and full member 405 and first partial member 410).

Further at step 520, a player may roll die 120 (e.g., a 6-sided die including numbers 1-6 or any other suitable set of letters, characters, or symbols that may match or correspond to markings 245). In at least some exemplary embodiments, die 120 may be of a fourth color that may correspond to a color of board member 420 (e.g., of protrusion 420*c*). A player may rotate board member 420 about multilevel support assembly 205 so that protrusion 420*c* points to a desired reference numeral or character of markings 245 based on a roll of die 120. For example, protrusion 420*c* may point to any of markings "1" through "30" (e.g., or any other desired numbers or characters) illustrated at the upper right quarter of surface 240 of base member 210. In at least some exemplary embodiments, protrusion 420*c* may be moved based on cumulative rolls of die 120. For example, protrusion 420*c* may be placed at "1" at the beginning of a game of board game system 100, and progressively moved from "1" toward "30" or any other suitable progression each turn as game play continues (e.g., moved from "1" to "3" on a first turn based on a roll of "2" of die 120, then moved from "3" to "9" on a second turn based on a roll of "6" of die 120, then moved from "9" to "12" on a third turn based on a roll of "3" of die 120, and so on until "30" or any other desired end point is reached). Rolls of die 120 may thereby determine a number of turns of a game of board game system 100 (e.g., number of turns taken to reach "30" or any other desired end point). A "turn" may correspond to an iteration of steps 515 through 545 as described herein. Because full member 405, first partial member 410, and second partial member 415 may be selectively held or maintained in place on base member 210, full member 405, first partial member 410, and second partial member 415 may not move or rotate as board member 420 is moved or rotated. The player may then utilize one or more fastener assemblies 250 for example as described above to selectively hold or maintain board member 420 in place relative to base member 210 (e.g., and full member 405, first partial member 410, and second partial member 415). Also in at least some exemplary embodiments in which board member 420 is a top member of variable threat assembly 400, board member 420 may not be fastened to base member 210, and a number or character to which protrusion 420*c* is pointing may be noted by a player for use (e.g., to be added to on a next roll of die 120) on the next turn. Markings 405*b* of full member 405, markings 410*b* of first partial member 410, and/or markings 415*b* of second partial member 415 may be visible to players through apertures 425 of board member 420 based on the positions of members 405, 410, 415, and 420 relative to each other (e.g., and/or to base member 210). Because the positions of members 405, 410, 415, and 420 may be determined by chance (e.g., based on rolling dice 115 and 120), the particular exemplary disclosed markings that are visible through apertures 425 may be randomized each turn. Because a significant number of possible combinations of relative positions of members 405, 410, 415, and 420 may exist, it may be unlikely that a given player may see the same sequence of markings appear through apertures 425 (e.g., it is unlikely that the same sequence of markings of a given game using board game system 100 may be repeated in another game of board game system 100 played by a given player).

In at least some exemplary embodiments and for example as described herein, a plurality of rows of apertures 425 may be disposed at intervals (e.g., at quarters, thirds, fifths, sixths, eighths, or any other desired interval) around board member 420, which may allow a subset of markings 405*b* of full member 405, markings 410*b* of first partial member 410, and/or markings 415*b* of second partial member 415 to be visible to players through apertures 425. Second partial member 415 and first partial member 410 may cover some of markings 405*b* of full member 405.

For example as illustrated in FIGS. 5-7, when second partial member 415 may be a single wedge covering a quarter-circle and first partial member 410 may be a double-wedge covering a half-circle, member 415 may or may not cover member 410, and members 415 and 410 may cover half or three-quarters of full member 405. For example, when second partial member 415 is disposed over first partial member 410 based on the exemplary positions and die rolls described above, second partial member 415 may cover about half of first partial member 410, and members 415 and 410 together may cover about half of full member 405. Also for example, when second partial member 415 is not disposed over first partial member 410 based on the exemplary positions and die rolls described above, second partial member 415 may not cover first partial member 410 and may cover about a quarter of full member 405, and first partial member 410 may cover about half of full member 405 (e.g., members 415 and 410 may together cover three-quarters of full member 405 for example as illustrated in FIG. 2). In this way in at least some exemplary embodiments, between about one-half and about three-quarters of full member 405 may be covered by members 410 and 415, and member 415 may sometimes cover about half of member 410. Any desired number of members of variable threat assembly 400 having any desired shape or configuration may be provided to similarly produce any desired combination of different fractions of members that may be covered by other members. Random sequences of subsets of numerals or characters of the exemplary disclosed markings (e.g., markings 405*b*, 410*b*, and 415*b*) may thereby be visible to players through apertures 425 (e.g., and through transparent members 305, 310, and 315) during a plurality of turns of game play of board game system 100. Apparatus 105 may thereby provide a variable threat or opponent to one or more players of board game system 100 based on number values, symbols, letters, or other characters selectively shown through apertures 425 to players on a given turn for example as described herein.

In one exemplary embodiment and as illustrated in FIGS. 2 and 4, a row of apertures 425 may correspond to each of four players (e.g., each player may control or defend one-quarter of board member 420 with each player having a plurality of locations 420*d*). A token 135 representing a city may be placed on each location 420*d*. One or more markers 130 representing a gunship may be placed at given locations 420*d* or on corresponding portions of members 305, 310, and 315 disposed over locations 420*d*, with the gunships defending the cities. Based on playing cards 125 drawn by the players as described herein, the gunships may be created, increased in power by moving up progressive members 305, 310, 315, and/or increased in armament. For example, a combination of altitude and armament of markers 130 may result in a value for defense of a given location 420*d* defended by one or more given markers 130. Cities themselves represented by tokens 135 may also include a value (e.g., a defense value). A total defense value of a given location 420*d* of board member 420 may thereby be determined based on a value of token 135, an armament of each marker 130, and an altitude of each marker 130 (e.g., with the value increasing as marker 130 moves up from member 305 to member 310 and then member 315). The defense value may then be compared as described below to an attack value of variable threat assembly 400 (e.g., that may be determined by the numbers or other characters appearing through apertures 425). For example, each aperture 425 may correspond to a given location 420*d*, with an attack value on that location 420*d* provided by the number or character visible through that aperture 425. For example as illustrated in FIGS. 2 and 4, apparatus 105 may include 20 apertures 425 corresponding to 20 locations 420*d* (e.g., or any other desired number). Variable threat assembly 400 may thereby provide a simultaneous variable threat attack on four regions each controlled by a player and each including five cities represented by tokens 135 (e.g., or any other desired number). Because variable threat assembly 400 may provide a randomized threat, a single player may also play against an unpredictable threat provided by variable threat assembly 400.

Variable threat assembly 400 may represent any desired threat based on a genre of game provided by board game system 100. For example, variable threat assembly 400 may represent air raids on cities (e.g., Battle of Britain), a global alien attack on earth, attacks of dragons on castles, an evil monster or wizard attacking players, or any other desired fictional, historical, or real world threat.

At step 525 in some exemplary embodiments, players may decide whether to leave an alliance system of board game system 100. For example because apparatus 105 may provide a threat or opponent that players may mutually or collectively play against, players may begin the game in an alliance against the common threat or opponent provided by apparatus 105 and/or form an alliance during game play. In at least some exemplary embodiments, some attacks or threats against locations 420*d* (e.g., numbers or characters for example of markings 405*b*, 410*b*, and/or 415*b*) displayed through apertures 425 may be extreme attacks (e.g., treaty actions denoted for example by a "T" or other character or symbol displayed through apertures 425) for which a player facing such an attack may receive help from other players. For example if one or more of a player's locations 420*d* faces such an attack, other players in an alliance with that player would give that player some or all of their playing cards 125. In doing so, players may strengthen the position of the player undergoing extreme attack while simultaneously weakening their own position. Accordingly, a player may decide to withdraw from the alliance or treaty to be able to retain playing cards 125 (e.g., not give away playing cards 125 providing the exemplary disclosed advantages). However, once a player withdraws from the alliance, that player can no longer receive help from other players (e.g., additional playing cards 125) if the withdrawing player undergoes an extreme or treaty attack later during game play of board game system 100. Accordingly, withdrawing from the alliance or treaty at step 525 may weaken the withdrawing player's position later in the game (though temporarily strengthening the withdrawing player's position that turn by preserving the withdrawing player's playing cards 125). However, in cases in which a player has drawn particularly advantageous playing cards 125 in a given round, withdrawing from the alliance or treaty to maintain those playing cards 125 may be worth the risk. However, as players withdraw from the alliance, the overall position of all players may degrade and all players may lose against the threat attacks of variable threat assembly 400 as it may become difficult for each player to withstand more extreme threat attacks of treaty actions on their own. For example as described herein, values of numbers associated with treaty actions displayed through apertures 425 may be so high that a player may lose one or more markers or tokens if facing that threat without assistance, and players may be eliminated from the game separately as variable threat assembly 400 "attacks" each player randomly throughout game play. The level of attacks may also increase based on increasing values of markings 405*b*, 410*b*, and 415*b* for example as described herein.

At step 530 in some exemplary embodiments, players remaining in the exemplary disclosed treaty or alliance may redistribute resources within the alliance. For example, players remaining in the alliance may each give up to three playing cards 125 (e.g., or any other number and/or one or more markers 130 that may represent defensive units such as gunships) to another player (e.g., or players) undergoing an extreme or treaty action (e.g., denoted by a character such as "T" appearing through apertures 425 corresponding to the attacked players locations 420*d*).

At step 535, each player may develop and move forces. For example, players may build markers 130, move markers 130 between regions of members 420, 305, 310, and 315 and between different members 420, 305, 310, and 315 (e.g., moving up from member 420 to members 305, 310, and/or 315). Players may play research and development (R&D) breakthrough cards for altitude (e.g., allowing a player to move markers 130 up one additional level in general for example from board member 420 to first member 305, which may make markers 130 more powerful for game play). Players may play R&D breakthrough cards for armament (e.g., making markers 130 more powerful for game play). Players may for example move or concentrate defensive power (e.g., markers 130) at their locations 420*d* facing greater threats (e.g., greater values of numbers appearing through corresponding apertures 425). Each player may attempt to move markers 130 so that sufficient defensive strength is present at each location 420*d* controlled by the player so that the defensive strength is equal to or exceeds an attack value (e.g., a value appearing through aperture 425) at each location 420*d*. Depending on available defensive strength of markers 130 and tokens 135, a player may choose to abandon one or more tokens 135 to successfully defend other tokens 135 (e.g., move markers 130 that may represent defensive units to defend select tokens 135).

At step 540, each player may defend against threat attacks and may take casualties. For each location 420*d* on which a token 135 has survived to that point in game play (e.g., has survived earlier attacks), each player determines a total defensive strength. For example, the total defensive strength of a given location 420*d* may be equal to a value of each marker 130 defending the given location 420*d* plus the value of the token 135 located at the given location 420*d*. For example, the token 135 located at the given location 420*d* may have a value of between 1 and 5. Also for example, the value of each marker 130 defending the given location 420*d* may be a product of an armament value (e.g., 2, 4, 6, or 8 depending on an amount of armament R&D playing cards 125*b* drawn by the player in game play to that point) and an altitude value (e.g., 0 if marker 130 is on board member 420, 1 if marker 130 is on first member 305, 2 if marker 130 is on second member 310, and 3 if marker 130 is on third member 315, which may depend on the amount of altitude R&D playing cards 125*a* a player has received to that point in game play for example as described herein). For example, if a player has a token 135 with a defense value of 3 and one marker 130 having an armament value of 4 disposed on second member 310 for an altitude value of 2, the total defense strength would be 3+4*2=11. This value may then be compared to a number visible through the aperture 425 corresponding to the given location 420*d*. For example, if that number appearing through aperture 425 is 11 or below, the player defeats the attack that turn at the given location 420*d* (e.g., the defense is successful and that token 135 survives). Alternatively for example, if that number appearing through aperture 425 is 12 or greater, the player loses the attack that turn at the given location 420*d*. The exemplary disclosed treaty attacks may include any suitable indication such as, for example, "T15" (which in this case would result in the player losing the attack based on a treaty attack value of 15, with "T" denoting a treaty attack). For example if the player loses the attack at the given location 420*d*, all markers 130 defending the given location 420*d* may be "destroyed" and removed from play and/or the token 135 (e.g., a city or city region) may be destroyed and removed from play. The threat attack to each location 420*d* may be similarly resolved based on comparing numbers appearing through apertures 425 to corresponding defensive values for example as determined similarly to above. The values may be set or determined in any suitable manner, with a defensive value being compared to a threat attack value provided by apparatus 105.

The exemplary disclosed numbers appearing through apertures 425 (e.g., markings 405*b*, 410*b*, and/or 415*b*) may be designed, configured, and/or calibrated to correspond to an expected increase in defensive strength to be achieved by players to provide for exciting game play. For example, the values for threat attack of markings 405*b*, 410*b*, and/or 415*b* may increase as game play continues (e.g., the markings may increase as play progresses based on protrusion 420*c* of board member 420 moving from "1" to "30" for example as described above regarding board member 420 and markings 245).

For example as illustrated in FIG. 8, the exemplary disclosed markings (e.g., markings 405*b*, 410*b*, and/or 415*b*) may increase in a direction of rotation, which may provide for increasing values of numbers to be visible through apertures 425 as game play progresses. For example as illustrated in FIGS. 2 and 8, the five columns of numbers may be visible through five respective apertures 425. As protrusion 420*c* of board member 420 is moved from for example "1" to "30" of markings 245 illustrated in FIG. 2, numbers appearing through apertures 425 may increase in value, which may represent an increasing threat attack level against which players may defend. The rotation of board member 420 may thereby provide for an increasing threat attack level as game play progresses. The exemplary disclosed rotation of members 405, 410, and 415 may provide for variation (e.g., randomization) of threat attack sequences between turns and games of board game system 100. For example, depending on whether each of protrusion 405*c* of full member 405, protrusion 410*c* of first partial member 410, and protrusion 415*c* of second partial member 415 is fastened to "1" through "4" for example as illustrated in FIG. 2, different sets of markings 405*b*, 410*b*, and/or 415*b* may be visible to different players through apertures 425 for the locations 420*d* that they are defending. For example, the exemplary disclosed rotation of members 405, 410, and 415 may prevent threat attacks of variable threat assembly 400 from becoming repetitive or predictable. Game play of board game system 100 may thereby remain varied and unpredictable for players who may play board game system 100 many times.

Markings 405*b*, 410*b*, and 415*b* may be provided based on an average increase in defensive strength that players may be expected to gain from playing cards 125 during game play based on a composition of the deck of playing cards 125 (e.g., based on the available numbers of playing cards 125*a*, 125*b*, 125*c*, 125*d*, and 125*e* and the probability of players drawing certain playing cards during each turn). Accordingly, different levels of play may be provided based on members 405, 410, and 415 having different values of the exemplary disclosed markings. For example, a first side of members 405, 410, and/or 415 may be harder (e.g., have higher threat attack values against which to successfully defend) than a second side of members 405, 410, and/or 415. A threat level of apparatus 105 may thereby be set based on which side of each of members 405, 410, and/or 415 may be facing up for example as described below at step 560. Values of markings 405*b*, 410*b*, and 415*b* may be set to provide game play that is not too easy or not too difficult so that players do not find game play to be so easy as to be dull (e.g., easy victory every game) or so difficult as to be frustrating or pointless (e.g., defeat every game). Also for example, a composition of a deck of playing cards 125 may be varied to adjust a difficulty level of game play (e.g., more or less advantageous cards may be provided to adjust difficulty).

Returning to FIG. 17, at step 545 players may determine whether a threat remains for example based on markings 245 (e.g., whether "30" or any other desired end point has been achieved based on the exemplary disclosed rolling of die 120). If additional turns remain in game play, process 500 may return to step 515 and steps 515 through 545 may be repeated as desired and/or until "30" of markings 245 or any other suitable number or desired end point is reached. Also for example as turns are repeated, fastener assemblies 250 may be detached to allow members 405, 410, 415, and 420 to be moved (e.g., rotated) and then selectively attached to maintain or hold members 405, 410, 415, and 420 in place at step 520 for example as described above. Also for example, a number of playing cards 125 provided to players may be reduced as a number of tokens 135 successfully defended and maintained by a given player decreases (e.g., as tokens 135 are eliminated or destroyed as described above). If a desired end point is reached (e.g., protrusion 420*c* of board member 420 has been rotated for example as described above until "30" or some other number or desired end point may be reached), game play may end and process 500 may proceed to step 550.

At step 550, game play may be evaluated. Although the players may cooperate during game play against a common opponent or threat provided by variable threat assembly 400, an individual winner may be determined and/or game play of each player may be ranked if desired. For example, players may be evaluated or ranked based on a number of tokens 135 that have been successfully defended and maintained by players until the end of game play. Players may also be evaluated or ranked based on a difficulty level of game play. For example, a rank structure (e.g., military ranks such as between private and general or fantasy skill levels) may be provided and players may be ranked based on difficulty level and number of tokens 135 remaining at the end of game play. Certain ranks may be available or unavailable based on the level of difficulty of play selected for play (e.g., based on whether or not more difficult or higher number sides of members 405, 410, and 415 and higher values of markings 405*b*, 410*b*, and 415*b* are facing upward or downward during assembly of apparatus 105 at step 510). For example, the highest ranks such as a three or a four star general may be available when apparatus 105 is configured for the highest difficulty level of play (e.g., all of the more difficult sides of members 405, 410, and 415 are facing upward). Players may therefore compete against themselves for achieving their highest overall rank, and may continue to play against the variable or random exemplary disclosed threat attack sequences provided by variable threat assembly 400 to attempt to achieve higher ranks.

At step 555, players (e.g., one player or a plurality of players) may decide whether or not to play again at a same threat level. If players would like to play at the same threat level, process 500 may return to step 515 and players may distribute new resources and begin a new game. If players would not like to play again at the same threat level, process 500 may proceed to step 560.

At step 560, players (e.g., one player or a plurality of players) may decide whether or not to play again at a different threat level. If players would like to play at a different threat level, players may disassemble apparatus 105. Players may then reassemble apparatus 105 with a desired side of each of members 405, 410, 415, and 420 facing upward. For example, each of members 405, 410, and 415 may have a lower threat side including respective markings 405*b*, 410*b*, and 415*b* having lower values than a higher threat side (e.g., opposite surface or side) of respective members 405, 410, and 415 having relatively higher values of markings 405*b*, 410*b*, and 415*b*. Different combinations of different sides of members 405, 410, and 415 facing upward may provide different overall difficulty levels of variable threat assembly 400. For example, an easiest overall threat level may be provided when the relatively easier side of all of members 405, 410, and 415 are facing upward. More difficult overall threat levels may be provided as one or some of members 405, 410, and/or 415 are flipped to have their more difficult sides facing upward. As this is done, progressively higher overall average values of markings 405*b*, 410*b*, and 415*b* may be visible through apertures 425 during game play, for example making game play more difficult. A most difficult overall threat level may be provided when the relatively more difficult sides of all of members 405, 410, and 415 are facing upward. Board member 420 may similarly have an easier side and a more difficult side (e.g., having more or less locations 420*d* to successfully defend and more or less opportunities to have more tokens 135 remaining at the end of game play). A composition of a deck of playing cards 125 may also be varied to make game play more or less difficult. If players do not wish to play at a different threat level, process 500 may end at step 565.

The exemplary disclosed game board apparatus including the exemplary disclosed variable threat assembly (e.g., variable threat assembly 400) may be used to provide a common threat or opponent to one or more (e.g., two, three, four, five, six, or more) players for any desired game genre. For example, an air raid threat (e.g., World War II air raid, alien attack, or ballistic missile attack), a naval threat (e.g., submarine threat), a fantasy threat (e.g., a demon, monster, or evil character), or any other desired threat or opponent may be represented and provided during game play by the exemplary disclosed variable threat assembly (e.g., variable threat assembly 400).

In at least some exemplary embodiments, the exemplary disclosed game board apparatus may include a support assembly (e.g., support assembly 200), a first member (e.g., member 405, 410, or 415) rotatably supported by the support assembly, a second member (e.g., member 405, 410, or 415) rotatably supported by the support assembly and covering part of the first member, a board member (e.g., board member 420) rotatably supported by the support assembly and including a plurality of apertures (e.g. apertures 425), the board member covering the first member and the second member, and a raised member (e.g., member 305, 310, or 315) rotatably supported by the support assembly above the board member and forming a gap between the raised member and the board member. A first portion of the first member and a second portion of the second member may be visible from above the board member through the plurality of apertures. The second member may be disposed between the first member and the board member, a bottom surface of the second member contacting a top surface of the first member and a top surface of the second member contacting a bottom surface of the board member. The exemplary disclosed game board apparatus may also include a bottom member rotatably supported by the support assembly. The first member and the second member may cover part of the bottom member. The first portion of the first member, the second portion of the second member, and a third portion of the bottom member may be visible from above the board member through the plurality of apertures. The bottom member may be a circular member, the first member may be a double-wedge member or a semicircular member having at least half of a surface area of the bottom member, and the second member may be a wedge member having at least a quarter of the surface area of the bottom member. The first portion of the first member and the second portion of the second member may include a plurality of characters that may be visible from above the board member through the plurality of apertures. The raised member may be transparent and the first portion of the first member and the second portion of the second member may be visible from above the raised member through the raised member and the plurality of apertures. The exemplary disclosed game board apparatus may further include a second raised member that may be rotatably supported by the support assembly above the raised member and may form a second gap between the second raised member and the raised member. The support assembly may include a first support member configured to be received in a first aperture of the first member, a second aperture of the second member, and a third aperture of the board member, and a second support member configured to be received in an aperture of the raised member, the first support member having a larger width or diameter than the second support member.

In at least some exemplary embodiments, the exemplary disclosed method may include rotatably supporting a first member (e.g., full member 405) using a support assembly (e.g., support assembly 200), rotatably supporting a second member (e.g., first partial member 410) using the support assembly, the second member covering part of the first member, rotatably supporting a third member (e.g., second partial member 415) using the support assembly, the third member covering part of at least one of the first and second members, rotatably supporting a board member (e.g., board member 420) using the support assembly, the board member covering the first, second, and third members and including a plurality of apertures (e.g. apertures 425), rotating a first location of the first member to one of a first plurality of locations (e.g., "1" through "4" of markings 245 or any other suitable locations) of the support assembly based on a first random event, rotating a second location of the second member to one of the first plurality of locations of the support assembly based on a second random event, rotating a third location of the third member to one of the first plurality of locations of the support assembly based on a third random event, rotating a fourth location of the board member to one of a second plurality of locations (e.g., "1" through "30" of markings 245 or any other suitable locations) of the support assembly based on a fourth random event, and viewing a first portion of the first member, a second portion of the second member, and a third portion of the third member from above the board member through the plurality of apertures. The exemplary disclosed method may also include providing each of the first random event, the second random event, and the third random event based on rolling a die including characters corresponding to characters marking the first plurality of locations of the support assembly. The exemplary disclosed method may further include rotatably supporting a plurality of raised members above the board member using the support assembly, the plurality of raised members forming a first gap between the board member and a lowermost raised member of the plurality of raised members and a plurality of gaps between the plurality of raised members. The exemplary disclosed method may additionally include rotating the plurality of raised members by a same amount and a same direction as the rotation of the board member. The exemplary disclosed method may also include moving markers from a surface of the board member to surfaces of the plurality of raised members based on cards provided from a deck of playing cards. The exemplary disclosed method may further include displaying numbers of increasing value through the plurality of apertures at the first portion of the first member, the second portion of the second member, and the third portion of the third member during successive rotations of the first, second, and third members based on rotating the fourth location of the board member along the second plurality of locations of the support assembly.

In at least some exemplary embodiments, the exemplary disclosed game board apparatus may include a support assembly (e.g., support assembly 200), a bottom member (e.g., full member 405) rotatably supported by the support assembly, a first member (e.g., first partial member 410) rotatably supported by the support assembly and covering part of the bottom member, a second member (e.g., second partial member 415) rotatably supported by the support assembly and covering either part of the first member or part of the bottom member, a board member (e.g., board member 420) rotatably supported by the support assembly and including a plurality of apertures (e.g., apertures 425), the board member covering the first member, the second member, and the bottom member, and a plurality of raised members (e.g., members 305, 310, and/or 315) rotatably supported by the support assembly above the board member and forming a gap between the plurality of raised members and the board member. A first portion of the first member, a second portion of the second member, and a third portion of the bottom member may be visible from above the board member through the plurality of apertures. The plurality of raised members may include a lowermost transparent member that may form the gap, a second transparent member that may be smaller than and disposed above the lowermost transparent member and may form a second gap between the lowermost transparent member and the second transparent member, and a third transparent member that may be smaller than and disposed above the second transparent member and may form a third gap between the second transparent member and the third transparent member. The bottom member may be a circular member having a protrusion that may be configured to be removably fastened to a plurality of fastener assemblies disposed on the support assembly. The first member and the second member may each be a wedge member, a double-wedge member, or a semi-circular member having a protrusion that may be configured to be removably fastened to a plurality of fastener assemblies disposed on the support assembly. The first and second members may be disposed between the bottom member and the board member and may each have surface areas that are less than a surface area of each of the bottom member and the board member. The plurality of apertures may include a plurality of rows of apertures that may be aligned in a plurality of radial directions of the board member.

In at least some exemplary embodiments, the exemplary disclosed system, apparatus, and method may provide an efficient and effective board game apparatus in which players may work together to defeat a common threat or opponent. The exemplary disclosed system, apparatus, and method may also provide a compelling solitaire game that may be played by a single player against a variable threat or opponent provided by an apparatus integrated into the game. Further, the exemplary disclosed system, apparatus, and method may provide game play in which one or more players may compete in three-dimensions against a threat or opponent provided by a moving apparatus of the board game itself.

It will be apparent to those skilled in the art that various modifications and variations can be made to the exemplary disclosed system, apparatus, and method. Other embodiments will be apparent to those skilled in the art from consideration of the specification and practice of the exemplary disclosed system, apparatus, and method. It is intended that the specification and examples be considered as exemplary, with a true scope being indicated by the following claims.

What is claimed is:

1. A game board apparatus, comprising:

a support assembly;

a first member rotatably supported by the support assembly;

a second member rotatably supported by the support assembly and covering part of the first member;

a board member rotatably supported by the support assembly and including a plurality of apertures, the board member covering the first member and the second member; and a raised member rotatably supported by the support assembly above the board member and forming a gap between the raised member and the board member;

wherein a first portion of the first member and a second portion of the second member are visible from above the board member through the plurality of apertures; and wherein the second member is disposed between the first member and the board member, a bottom surface of the second member contacting a top surface of the first member and a top surface of the second member contacting a bottom surface of the board member.

2. The game board apparatus of claim 1, further comprising a bottom member rotatably supported by the support assembly;

wherein the first member and the second member cover part of the bottom member; and wherein the first portion of the first member, the second portion of the second member, and a third portion of the bottom member are visible from above the board member through the plurality of apertures.

3. The game board apparatus of claim 2, wherein the bottom member is a circular member, the first member is a double-wedge member or a semicircular member having at least half of a surface area of the bottom member, and the second member is a wedge member having at least a quarter of the surface area of the bottom member.

4. The game board apparatus of claim 1, wherein the first portion of the first member and the second portion of the second member include a plurality of characters that are visible from above the board member through the plurality of apertures.

5. The game board apparatus of claim 1, wherein the raised member is transparent and the first portion of the first member and the second portion of the second member are visible from above the raised member through the raised member and the plurality of apertures.

6. The game board apparatus of claim 1, further comprising a second raised member that is rotatably supported by the support assembly above the raised member and forms a second gap between the second raised member and the raised member.

7. A game board apparatus, comprising:

a support assembly;

a bottom member rotatably supported by the support assembly;

a first member rotatably supported by the support assembly and covering part of the bottom member;

a second member rotatably supported by the support assembly and covering either part of the first member or part of the bottom member;

a board member rotatably supported by the support assembly and including a plurality of apertures, the board member covering the first member, the second member, and the bottom member; and a plurality of raised members rotatably supported by the support assembly above the board member and forming a gap between the plurality of raised members and the board member;

wherein a first portion of the first member, a second portion of the second member, and a third portion of the bottom member are visible from above the board member through the plurality of apertures; and wherein the bottom member is a circular member having a protrusion that is configured to be removably fastened to a plurality of fastener assemblies disposed on the support assembly.

8. The game board apparatus of claim 7, wherein the plurality of raised members includes a lowermost transparent member that forms the gap, a second transparent member that is smaller than and disposed above the lowermost transparent member and forms a second gap between the lowermost transparent member and the second transparent member, and a third transparent member that is smaller than and disposed above the second transparent member and forms a third gap between the second transparent member and the third transparent member.

9. The game board apparatus of claim 7, wherein the first and second members are disposed between the bottom member and the board member and each have surface areas that are less than a surface area of each of the bottom member and the board member.

10. The game board apparatus of claim 7, wherein the plurality of apertures includes a plurality of rows of apertures that are aligned in a plurality of radial directions of the board member.

11. A game board apparatus, comprising:

a support assembly;

a first member rotatably supported by the support assembly;

a second member rotatably supported by the support assembly and covering part of the first member;

a board member rotatably supported by the support assembly and including a plurality of apertures, the board member covering the first member and the second member; and a raised member rotatably supported by the support assembly above the board member and forming a gap between the raised member and the board member;

wherein a first portion of the first member and a second portion of the second member are visible from above the board member through the plurality of apertures; and wherein the support assembly includes a first support member configured to be received in a first aperture of the first member, a second aperture of the second member, and a third aperture of the board member, and a second support member configured to be received in an aperture of the raised member, the first support member having a larger width or diameter than the second support member.

12. The game board apparatus of claim 11, further comprising a bottom member rotatably supported by the support assembly;

wherein the first member and the second member cover part of the bottom member; and wherein the first portion of the first member, the second portion of the second member, and a third portion of the bottom member are visible from above the board member through the plurality of apertures.

13. The game board apparatus of claim 12, wherein the bottom member is a circular member, the first member is a double-wedge member or a semicircular member having at least half of a surface area of the bottom member, and the second member is a wedge member having at least a quarter of the surface area of the bottom member.

14. The game board apparatus of claim 11, wherein the first portion of the first member and the second portion of the second member include a plurality of characters that are visible from above the board member through the plurality of apertures.

15. The game board apparatus of claim 11, wherein the raised member is transparent and the first portion of the first member and the second portion of the second member are visible from above the raised member through the raised member and the plurality of apertures.

16. The game board apparatus of claim 11, further comprising a second raised member that is rotatably supported by the support assembly above the raised member and forms a second gap between the second raised member and the raised member.

17. A game board apparatus, comprising:

a support assembly;

a bottom member rotatably supported by the support assembly;

a first member rotatably supported by the support assembly and covering part of the bottom member;

a second member rotatably supported by the support assembly and covering either part of the first member or part of the bottom member;

a board member rotatably supported by the support assembly and including a plurality of apertures, the board member covering the first member, the second member, and the bottom member; and a plurality of raised members rotatably supported by the support assembly above the board member and forming a gap between the plurality of raised members and the board member;

wherein a first portion of the first member, a second portion of the second member, and a third portion of the bottom member are visible from above the board member through the plurality of apertures; and wherein the first member and the second member are each a wedge member, a double-wedge member, or a semicircular member having a protrusion that is configured to be removably fastened to a plurality of fastener assemblies disposed on the support assembly.

18. The game board apparatus of claim 17, wherein the plurality of raised members includes a lowermost transparent member that forms the gap, a second transparent member that is smaller than and disposed above the lowermost transparent member and forms a second gap between the lowermost transparent member and the second transparent member, and a third transparent member that is smaller than and disposed above the second transparent member and forms a third gap between the second transparent member and the third transparent member.

19. The game board apparatus of claim 17, wherein the first and second members are disposed between the bottom member and the board member and each have surface areas that are less than a surface area of each of the bottom member and the board member.

20. The game board apparatus of claim 17, wherein the plurality of apertures includes a plurality of rows of apertures that are aligned in a plurality of radial directions of the board member.

* * * * *